US005314110A

United States Patent [19]

Lombardo

[11] Patent Number: 5,314,110

[45] Date of Patent: May 24, 1994

[54] DOUBLE FOLD MAILER

[75] Inventor: Leo Lombardo, Manchester, N.H.

[73] Assignee: Moore Business Forms, Inc., Grand Island, N.Y.

[21] Appl. No.: 891,035

[22] Filed: Jun. 1, 1992

[51] Int. Cl.[5] ..... B65D 27/10

[52] U.S. Cl. ..... 229/92.1; 229/69; 229/314

[58] Field of Search ..... 229/92, 92.1, 92.3, 229/69, 313, 314, 316

[56] References Cited

U.S. PATENT DOCUMENTS

| | | | |
|---|---|---|---|
| 2,152,135 | 3/1939 | Case et al. | 229/92.1 |
| 3,228,586 | 1/1966 | Hayes, Jr. | 229/92.1 X |
| 3,837,565 | 9/1974 | Johnsen | 229/92.1 X |
| 3,981,435 | 9/1976 | Johnsen | 229/69 |
| 4,380,315 | 4/1983 | Steidinger | 229/314 X |
| 4,575,121 | 3/1986 | Conti | 229/69 X |
| 5,046,661 | 9/1991 | Kimura | 229/92.1 |
| 5,174,491 | 12/1992 | Taylor et al. | 229/92.1 |
| 5,174,493 | 12/1992 | File | 229/92.1 X |
| 5,201,464 | 4/1993 | File | 229/314 X |

FOREIGN PATENT DOCUMENTS

| | | | |
|---|---|---|---|
| 2252792 | 6/1975 | France | 229/92.1 |

OTHER PUBLICATIONS

Moore brochure, "The SpeediSealer © Pressure Seal System For Nonimpact Printers", Jun., 1990.

Moore Paragon "The PostMatic 830" brochure, Feb. 1979.

Moore "Pressure Seal . . . A New Age in Mailing Technology" brochure, Dec., 1990.

Moore Paragraph "An Introduction to Pressure Seal . . . " brochure Oct. 1990.

*Primary Examiner*—Allan N. Shoap
*Assistant Examiner*—Jes F. Pascua
*Attorney, Agent, or Firm*—Nixon & Vanderhye

[57] ABSTRACT

An intermediate, and a mailer type business form constructed from the intermediate, can be imaged on both sides and easily formed into a final product having four panels. A sheet of paper has first and second faces with first and second longitudinal marginal portions formed by first and second longitudinal perforations parallel to the longitudinal edges of the sheet. Pressure seal adhesive is disposed in longitudinally elongated patterns in the first and second longitudinal marginal portions on the first face, and first, second and third fold lines formed in the sheet divide the sheet into first, second, third and fourth panels of substantially equal size. Other elongated patterns of pressure seal adhesive are disposed in the first and second longitudinal marginal portions of the second face. The sheet is devoid of adhesive extending along the ends of the sheet, or parallel to the ends. The mailer is printed with information on the entire first face, and on the third and fourth panels of the second face, and an outgoing address, and directions for opening of the mailer, are provided on the second face of the first and/or second panel.

16 Claims, 3 Drawing Sheets

DOUBLE FOLD MAILER

BACKGROUND AND SUMMARY OF THE INVENTION

There is an ever present need for different types of mailer type business forms to accommodate a wide variety of different requirements of mailer customers. A number of simple and elegant mailers have been developed for use with pressure sealing systems, such as the SpeediSealer® pressure seal equipment manufactured by Moore Business Forms, Inc. of Lake Forest, Ill. Such mailers include V-fold, C-fold, and Z-fold types, with various patterns of pressure seal adhesive adjacent the longitudinal edges, and extending at the ends of the sheet forming the mailer transverse to the longitudinal edges.

According to the present invention, another type of mailer is provided which is useful in situations where it is desirable to provide only a single sheet construction, but where a great deal of information need be printed on the mailer. The mailer according to the invention is double folded to provide four panels of substantially the same size, each panel substantially the same size as the panels in a conventional C-fold or Z-fold mailer. While the invention is not limited to use with pressure seal adhesive (utilizable with the Moore SpeediSealer® system), it is particularly suited for such use. Because of the particular type of construction, no adhesive need be provided transverse to the longitudinal edges of the sheet of paper forming the mailer.

According to a first aspect of the present invention, a mailer type business form intermediate is provided. The intermediate comprises the following elements: A sheet of paper having a first face adapted to provide the majority of the interior of the mailer when constructed, and a second face adapted to provide the exterior of the mailer when constructed. The sheet having first and second opposite parallel longitudinal edges, and opposite end edges. First and second longitudinal lines of weakness formed in the sheet parallel to and adjacent, but spaced from, the first and second longitudinal edges, respectively, the lines of weakness defining, with the longitudinal edges, first and second longitudinal margin portions. First and second longitudinal elongated patterns of adhesive disposed in the first longitudinal marginal portion of the first face, parallel to the longitudinal edges, and collectively covering substantially the entire distance between the opposite ends of the sheet. Third and fourth longitudinal elongated patterns of adhesive disposed in the second longitudinal marginal portion of the first face, parallel to the longitudinal edges, and collectively covering substantially the entire distance between the opposite ends of the sheet. First, second and third fold lines formed in the sheet each perpendicular to the longitudinal edges, and dividing the sheet into, in sequence, first, second, third, and fourth panels of substantially equal size. Fifth and sixth elongated patterns of adhesive disposed in the first longitudinal marginal portion of the second face, parallel to the longitudinal edges, and collectively covering substantially the entire distance in the dimension of the longitudinal edges in the third and fourth panels. And seventh and eighth elongated patterns of adhesive disposed in the second longitudinal marginal portion of the second face, parallel to the longitudinal edges, and collectively covering substantially the entire distance in the dimension of the longitudinal edges in the third and fourth panels.

The sheet is preferably devoid of adhesive extending along the end edges of the sheet, or parallel to the end edges of the sheet. The first through eighth patterns are preferably discontinuous strips of pressure seal adhesive, being provided so that at no point along either of the longitudinal edges is there more than one pattern of adhesive on a face and in a particular marginal portion. The sheet preferably has dimensions of about 16 inches by about 8.5 inches, with tractor drive strips extending along the end edges, which tractor drive strips are severed before the final mailer is formed. The lines of weakness are typically perforations.

The invention also comprises a mailer type business form. The mailer type business form comprises: A double folded paper sheet having first and second faces, first and second opposite longitudinal edges, opposite end edges, and first, second and third transverse fold lines, perpendicular to the longitudinal edges, defining in sequence first, second, third, and fourth panels of substantially equal size. First and second longitudinal lines of weakness formed in the sheet parallel to and adjacent, but spaced from, the first and second longitudinal edges, respectively, the lines of weakness defining, with the longitudinal edges, first and second longitudinal marginal portions. First and second longitudinal elongated patterns of adhesive disposed in the first longitudinal marginal portion of the first face, parallel to the longitudinal edges, and collectively covering substantially the entire distance between the opposite end edges of the sheet. Third and fourth longitudinal elongated patterns of adhesive disposed in the second longitudinal marginal portion of the first face, parallel to the longitudinal edges, and collectively covering substantially the entire distance between the opposite ends of the sheet. Fifth and sixth elongated patterns of adhesive disposed in the first longitudinal marginal portion of the second face, parallel to the longitudinal edges, and collectively covering substantially the entire distance in the dimension of the longitudinal edges in the third and fourth panels. And seventh and eighth elongated patterns of adhesive disposed in the second longitudinal marginal portion of the second face, parallel to the longitudinal edges, and collectively covering substantially the entire distance in the dimension of the longitudinal edges in the third and fourth panels. The second and third panel first faces, and the first and fourth panel first faces, being in contact with each other, and the third and fourth panel second faces being in contact with each other, the panels held in those positions by the elongated adhesive patterns.

The entire first face and the third and fourth panels of the second face preferably have indicia (such as information) printed thereon. The second face of one or both of the first and second panels also has outgoing address information printed thereon. Also, indicia may be provided in at least one of the first and second longitudinal marginal portions of the second face to advise a user of the mailer how to open the mailer.

It is a primary object of the present invention to provide a mailer type business form that is simple to construct and utilize, and can contain a great detail of information. This and other objects of the invention will become clear from an inspection of the detailed description of the invention, and from the appended claims.

DETAILED DESCRIPTION OF THE DRAWINGS

Figure 1:
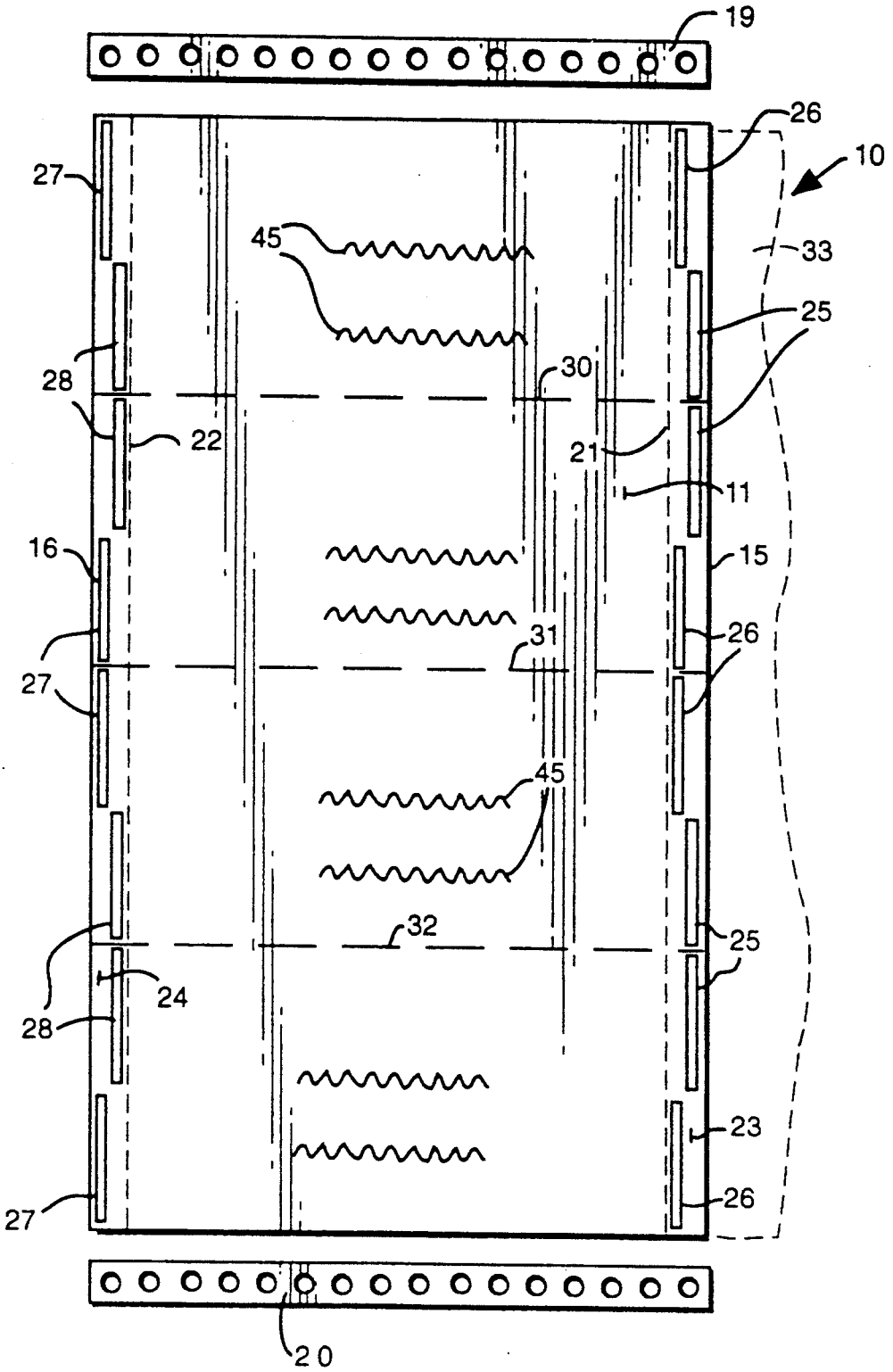
FIG. 1 is a plan view of a first face of an intermediate of a mailer type business form according to the invention.
Figure 2:
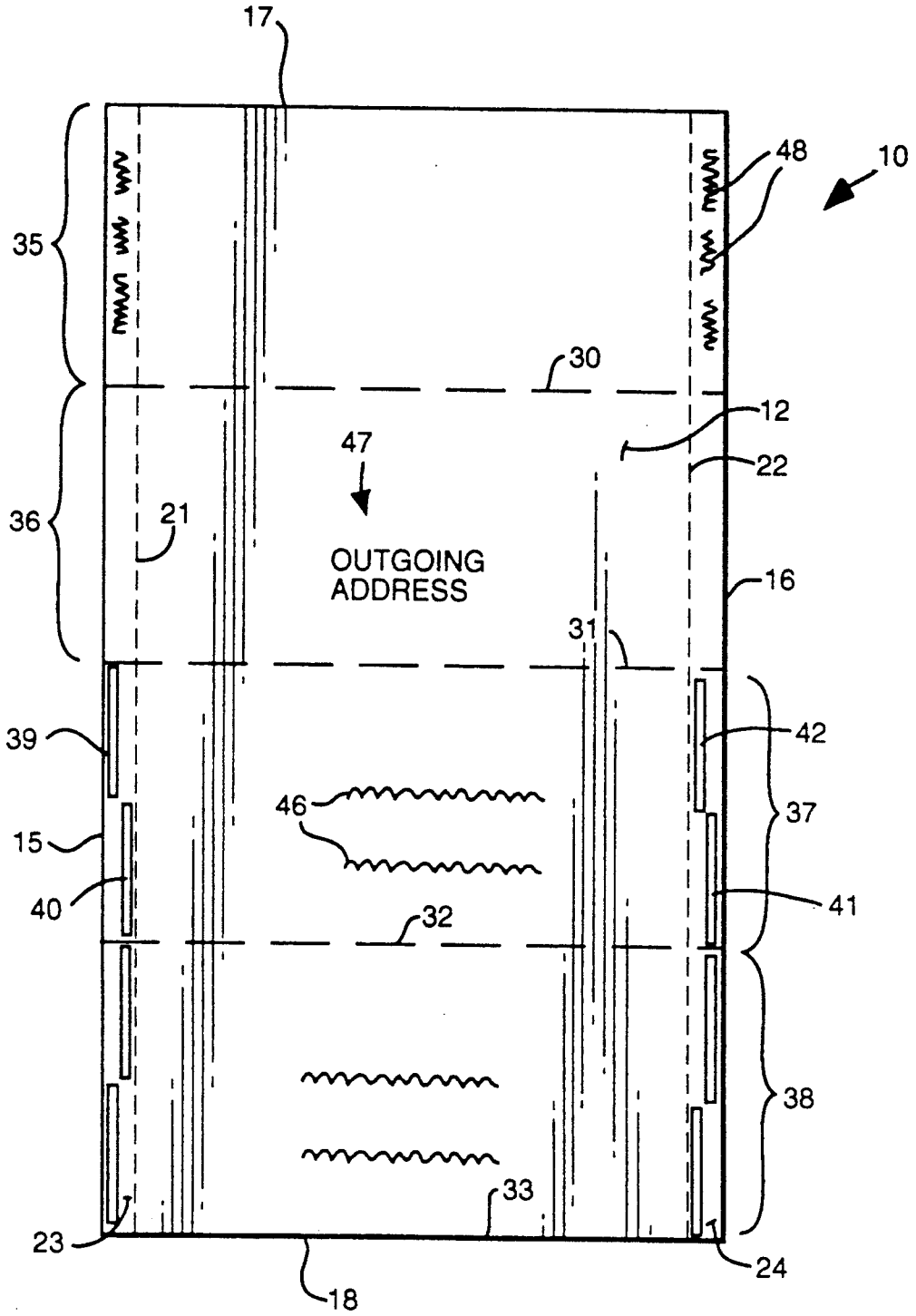
FIG. 2 is a plan view of the second face of the intermediate of FIG. 1.
Figure 4:
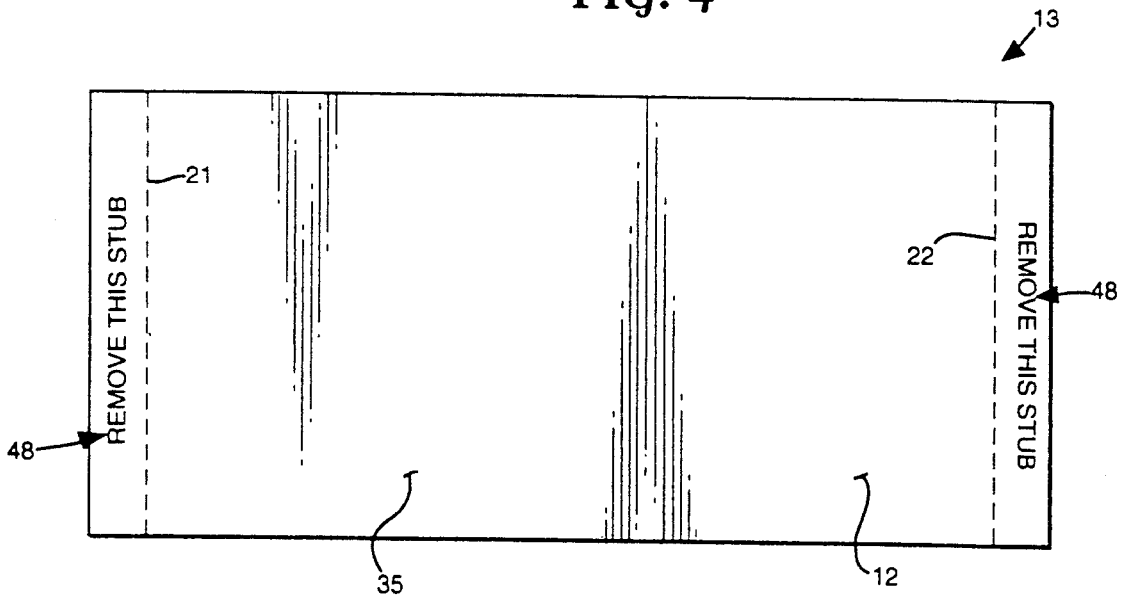
FIG. 4 is a top plan view of the first panel of an exemplary constructed mailer type business form according to the invention.

A mailer type business form according to the present invention is constructed from an intermediate, illustrated generally by reference numeral 10 in FIGS. 1 and 2. The intermediate comprises a sheet of paper (such as bond paper) having a first face 11 (FIG. 1), and a second face 12 (FIG. 2). The first face 11 is adapted to provide the majority of the interior of the mailer 13 (see FIG. 4) constructed from the intermediate 10, and the second face 12 is adapted to provide the exterior of the mailer when constructed. The sheet 10 has first and second opposite parallel longitudinal edges 15, 16, and opposite end edges 17, 18. When originally formed in continuous format, the edges 15, 16 are perf lines connecting the sheet to a like adjacent sheet (see dotted line configuration 33 in FIG. 1), and tractor drive strips 19, 20 (see FIG. 1) are provided at the end edges 17, 18. However, one of the final operations in the construction of the intermediates 10 is for the tractor drive strips portions 19, 20 to be severed with a conventional cutting mechanism.

The sheet forming the intermediate 10 has first and second longitudinal lines of weakness (e.g. perforations) 21, 22, parallel to but spaced from the edges 15, 16, and defining with the longitudinal edges 15, 16 first and second longitudinal marginal portions 23, 24. First and second longitudinal elongated patterns of adhesive 25, 26, respectively, are disposed in the first longitudinal marginal portion 23, while third and fourth like elongated longitudinal patterns of adhesive 27, 28 are disposed in the second marginal portion 24. While the adhesive patterns 25 through 27 may be of a wide variety of types, preferably they are discontinuous strips as illustrated in FIG. 1. Collectively the patterns 25, 26 and the patterns 27, 28 each cover substantially the entire length of the intermediate 10 between the end edges 17, 18, although at no point along either of the longitudinal edges 15, 16 is there more than one pattern of adhesive on the first face 11 and in a particular marginal portion 23, 24.

It is preferred that the adhesive patterns 25 through 28 comprise pressure seal adhesive (i.e. pressure activated adhesive, also known as pressure sensitive adhesive) rather than a heat activated adhesive or moisture activated adhesive. One example of a pressure seal adhesive that is particularly suitable is that produced by Toppan-Moore of Japan under the trade designation "TM-124", which is a styrene-natural rubber copolymer. Another commercially available adhesive that may be utilized is the Fuller HL-9016 adhesive. Other pressure sensitive adhesive compositions which may be satisfactory are those shown in U.S Pat. Nos. 3,041,308; 3,444,269; 3,449,471; 3,862,913; 4,228,256; 4,471,082; 3,644,579; 3,849,358; 4,483,951; and 4,397,992. This adhesive is used with a machine having rollers which apply pressure to the form during construction to seal the adhesive strips together. Such equipment may be of the type manufactured by Moore Business Forms, Inc. of Lake Forest, Ill. under the trademark "SPEEDISEALER ®" pressure sealing system.

The intermediate 10 also includes first, second, and third transverse fold lines 30, 31, and 32, respectively, which extend substantially perpendicular to the edges 15, 16 and substantially parallel to the end edges 17, 18. The fold lines thus divide the intermediate into first, second, third and fourth panels 35 through 38, respectively (see FIGS. 2 and 3). Fifth and sixth elongated patterns of adhesive 39, 40, identical or similar to the patterns 25 through 28, are formed in the first longitudinal marginal portion 23 just in the third and fourth panels 37, 38 on the second face 12 (see FIG. 2), while seventh and eighth elongated patterns of adhesive 41, 42 are provided in the second longitudinal marginal portion 24 in the third and fourth panels 37, 38 of the second face 12.

In the preferred embodiment illustrated in the drawings, there is no adhesive extending along the end edges 17, 18 of the sheet forming the intermediate 10, or parallel to the end edges 17, 18. The panels 35–38 each preferably have a width of about 8.5 inches and a length of about 3.5–4 inches, and are all of approximately the same size.

The intermediate 10 is preferably, although not necessarily, of substantial dimension, such as having a length (FIG. 1, with the tractor drive strips 19, 20) of about 16 inches and a width of about 8.5 inches. That leaves a large amount of area to be printed with indicia, as indicated at 45 in FIG. 1 (on all of the panels 35 through 38 of the first face 11), and as indicated at 46 in FIG. 2 (on the second face 12 in the third and fourth panels 37, 38). Also, outgoing address information 47 (see FIG. 2) is preferably printed on the second face 12 in the first or the second panel (illustrated in the second panel 36 in FIG. 2). Also, instructional indicia 48 (see FIGS. 2 and 4) is printed in one or both of the marginal portions 23, 24 of the second face 12 in one or both of the panels 35, 36 (shown only associated with the panel 35 in FIGS. 2 and 4) telling the recipient of the mailer 13 how to open it (i.e., by detaching along the perforations 21, 22).

Figure 3:
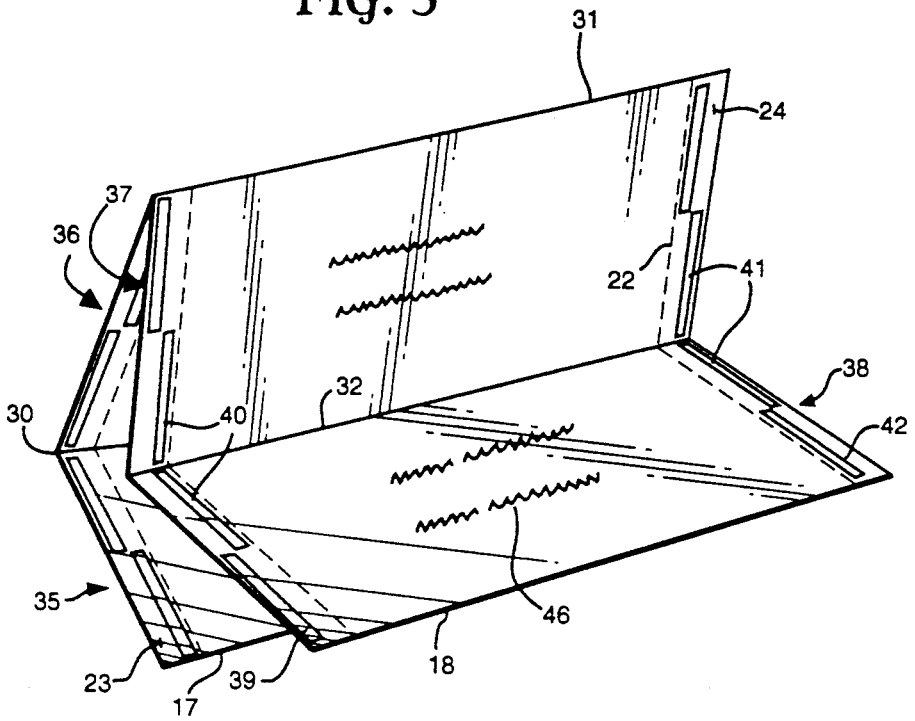
FIG. 3 is a top perspective view showing the intermediate of FIGS. 1 and 2 being double folded into a mailer type business form.

To make the mailer 13 from the intermediate 10, one first folds the intermediate 10 about the center fold line 31, so that the first face 11 of panel 36, 37 come into contact with each other, and the first face 11 of the panels 35, 38 come into contact with each other (see FIG. 3). Then the intermediate 10 is folded again about the fold lines 30, 32 so that the second face 12 of the third and fourth panels 37, 38 come in contact with each other. In these configurations, the continuous portions of the strips 25 match up with each other, as do the portions of all of the other strips 26 through 28, and 39 through 42. Then the form is run through a pressure sealing system with the rollers acting only on the marginal portions 23, 24 (the adhesive patterns) to activate the adhesive by pressure, and to form the final mailer 13. Mailer 13 will maintain its integrity when passing through the mails, and has the outgoing address 47 visible on the exterior thereof, as well as the instructional indicia 48 telling how the mailer 13 should be opened.

It will thus be seen that according to the present invention a simple and easy to construct intermediate, and mailer type business form, are provided which are capable of containing a large amount of information. While the invention has been herein shown and described in connection with what is presently considered to be the most practical and preferred embodiment, it is to be understood that the invention is not to be limited to the disclosed embodiment, but on the contrary, is intended to cover various structures and devices included within the spirit and scope of the appended claims.

What is claimed is:

1. An intermediate comprising:

a sheet of paper having a first face adapted to provide the majority of the interior of the mailer when constructed, and a second face adapted to provide the exterior of the mailer when constructed;

said sheet having first and second opposite parallel longitudinal edges, and opposite end edges;

first and second longitudinal lines of weakness formed in said sheet parallel to and adjacent, but spaced from, said first and second longitudinal edges, respectively, said lines of weakness defining, with said longitudinal edges, first and second longitudinal margin portions;

first and second longitudinal elongated patterns of adhesive disposed in said first longitudinal marginal portion of said first face, parallel to said longitudinal edges, and collectively covering substantially the entire distance between said opposite ends of said sheet;

third and fourth longitudinal elongated patterns of adhesive disposed in said second longitudinal marginal portion of said first face, parallel to said longitudinal edges, and collectively covering substantially the entire distance between said opposite ends of said sheet;

first, second and third fold lines formed in said sheet each perpendicular to said longitudinal edges, and dividing said sheet into, in sequence, first, second, third, and fourth panels of substantially equal size;

fifth and sixth elongated patterns of adhesive disposed in said first longitudinal marginal portion of said second face, parallel to said longitudinal edges, and collectively covering substantially the entire distance in the dimension of said longitudinal edges in said third and fourth panels;

seventh and eighth elongated patterns of adhesive disposed in said second longitudinal marginal portion of said second face, parallel to said longitudinal edges, and collectively covering substantially the entire distance in the dimension of said longitudinal edges in said third and fourth panels; and wherein said sheet is devoid of adhesive extending along said end edges of said sheet between said longitudinal lines of weakness.

2. An intermediate as recited in claim 1 wherein said first and second, third and fourth, fifth and sixth, and seventh and eighth patterns are elongated in a dimension of elongation and are discontinuous strips in the dimension of elongation thereof, so that at no point along either of said longitudinal edges is there more than one pattern of adhesive on a face and in a particular marginal portion.

3. An intermediate as recited in claim 2 wherein said adhesive is pressure seal adhesive.

4. An intermediate as recited in claim 3 wherein said sheet has the dimension of about 16 inches by about 8.5 inches.

5. An intermediate as recited in claim 2 wherein said intermediate has tractor drive strips extending along said ends thereof, which tractor drive strips are severable.

6. An intermediate as recited in claim 5 wherein said sheet has the dimensions of about 16 inches by 8.5 inches prior to severing of said tractor drive strips.

7. An intermediate as recited in claim 1 wherein said lines of weakness are perforations.

8. An intermediate as recited in claim 1 wherein said first and second, third and fourth, fifth and sixth, and seventh and eighth patterns are discontinuous strips in the dimension of elongation thereof, 1 so that at no point along either of said longitudinal edges is there more than one pattern of adhesive on a face and in a particular marginal portion.

9. An intermediate as recited in claim 8 wherein said adhesive is pressure seal adhesive.

10. An intermediate as recited in claim 1 in continuous format, said longitudinal edges being connected by lines of weakness to like sheets.

11. A mailer type business form comprising:

a double folded paper sheet having first and second faces, first and second opposite longitudinal edges, opposite end edges, and first, second and third transverse fold lines, perpendicular to said longitudinal edges, defining in sequence first, second, third, and fourth panels of substantially equal size;

first and second longitudinal lines of weakness formed in said sheet parallel to and adjacent, but spaced from, said first and second longitudinal edges, respectively, said lines of weakness defining, with said longitudinal edges, first and second longitudinal marginal portions;

first and second longitudinal elongated patterns of adhesive disposed in said first longitudinal marginal portion of said first face, parallel to said longitudinal edges, and collectively covering substantially the entire distance between said opposite end edges of said sheet;

third and fourth longitudinal elongated patterns of adhesive disposed in said second longitudinal marginal portion of said first face, parallel to said longitudinal edges, and collectively covering substantially the entire distance between said opposite ends of said sheet;

fifth and sixth elongated patterns of adhesive disposed in said first longitudinal marginal portion of said second face, parallel to said longitudinal edges, and collectively covering substantially the entire distance in the dimension of said longitudinal edges in said third and fourth panels;

seventh and eighth elongated patterns of adhesive disposed in said second longitudinal marginal portion of said second face, parallel to said longitudinal edges, and collectively covering substantially the entire distance in the dimension of said longitudinal edges in said third and fourth panels;

wherein said second and third panel first faces, and said first and fourth panel first faces, are in contact with each other, and said third and fourth panel second faces are in contact with each other, said panels held in those positions by said elongated adhesive patterns; and wherein said sheet is devoid of adhesive extending along said end edges of said sheet between said longitudinal lines of weakness.

12. A mailer as recited in claim 11 wherein said entire first face has indicia printed thereon, and said second face of said third and fourth panels has indicia printed thereon, and wherein said second face of one of said first and second panels has outgoing address information printed thereon.

13. A mailer as recited in claim 12 further comprising indicia formed in at least one of said first and second longitudinal marginal portions of said second face of one of said first and second panels advising a user of the mailer to detach the mailer along said lines of weakness.

14. A mailer as recited in claim 11 wherein each of said panels has a width of about 8.5 inches and a length of about 3.5–4 inches.

15. A mailer as recited in claim 11 wherein said adhesive is pressure seal adhesive.

16. A mailer as recited in claim 11 wherein said lines of weakness are perforations.

* * * * *